US005661496A

United States Patent [19]

Baek et al.

[11] Patent Number: 5,661,496

[45] Date of Patent: Aug. 26, 1997

[54] CAPACITIVE COUPLED EXTENDABLE ANTENNA

[75] Inventors: Rack June Baek; Jung Kun Oh; In Soo Hwang, all of Kyunggi-do, Rep. of Korea

[73] Assignee: Ace Antenna Corporation, Kyunggi-do, Rep. of Korea

[21] Appl. No.: 428,011

[22] Filed: Apr. 25, 1995

[30] Foreign Application Priority Data

Mar. 22, 1995 [KR] Rep. of Korea ..... 95-6117

[51] Int. Cl.[6] ..... H01Q 1/24

[52] U.S. Cl. ..... 343/702; 343/895; 343/901

[58] Field of Search ..... 343/702, 895, 343/901, 900, 715; H01Q 1/24

[56] References Cited

U.S. PATENT DOCUMENTS

| | | | |
|---|---|---|---|
| 4,868,576 | 9/1989 | Johnson, Jr. | 343/702 |
| 5,317,325 | 5/1994 | Bottomley | 343/895 |
| 5,438,339 | 8/1995 | Itoh et al. | 343/702 |
| 5,467,096 | 11/1995 | Takamoro et al. | 343/895 |

FOREIGN PATENT DOCUMENTS

| | | | |
|---|---|---|---|
| 0 467 822 A2 | 1/1992 | European Pat. Off. . | |
| 6-85519 | 3/1994 | Japan | H01Q 1/24 |
| WO94/10720 | 5/1994 | WIPO . | |

*Primary Examiner*—Hoanganh T. Le

*Attorney, Agent, or Firm*—Keck, Mahin & Cate

[57] ABSTRACT

An capacitive coupled extendable antenna for cordless telephones and for portable cellular telephones is disclosed. The antenna is operated, in its extended state, as the equivalent of a half-wave dipole antenna due to capacity capacitive coupling between the quarter-wave helical antenna element and the quarter-wave whip antenna element and compensates, in its retracted state, the deficient capacity component of the helical antenna element owing to capacity capacitive coupling between the metal sleeve and the helical antenna element. The antenna also improves the efficiency of the whip antenna element as well as the efficiency of the helical antenna element by coupling the metal sleeve to a tube under the condition that the whip antenna element is fully inserted into the tube.

6 Claims, 6 Drawing Sheets

(EXTENDED STATE)

(RETRACTED STATE)

(EXTENDED STATE)

(RETRACTED STATE)

(EXTENDED STATE)

(RETRACTED STATE)

CAPACITIVE COUPLED EXTENDABLE ANTENNA

BACKGROUND OF THE INVENTION

1. Field of the Invention

The present invention relates in general to an extendable radio antenna for cordless telephones and for portable cellular telephones and, more particularly, to a structural improvement in such an antenna for making the antenna in the retracted state be operated as the equivalent of a half-wave dipole antenna and for compensating for deficient capacity component of a helical antenna element of the antenna in the retracted state and for improving the efficiency of whip antenna element as well as the efficiency of helical antenna element, and improving the mechanical reliability of the antenna.

2. Description of the Prior Art

In prior art extendable antennas for domestic cordless telephones and for portable cellular telephones, a quarter-wave whip antenna element and a quarter-wave helical antenna element are integrated into an extendable antenna. When the integrated extendable antenna is in the retracted state during the carrying or keeping of the telephone, the radio frequency signals are received by the helical antenna element exclusively. However when the extendable antenna is in the extended state while talking over the telephone, only the whip antenna element is in the signal transmission and signal reception mode.

With reference to FIGS. 1A and 1B, there is shown the prior art extendable antenna in the fully extended state and in the fully retracted state respectively.

In the typical extendable antennas for cordless telephones, the whip antenna element and the helical antenna element are separated from each other at an interval such that the whip antenna element is exclusively operated in the extended state of the antenna while the helical antenna element is exclusively operated in the retracted state of the antenna. With the structural simplicity of the above extendable antennas, the antennas have been wide used in recent years.

However, as the above antenna is operated only by the helical antenna element during the retracted state of the antenna, the antenna has a problem of narrow bandwidth and low radiation efficiency. Another problem of the above antenna is resided in that the mechanical coupling portion between the whip antenna element and the helical antenna element is such frail that the coupling portion is apt to be broken.

SUMMARY OF THE INVENTION

It is, therefore, an object of the present invention to provide an capacitive coupled extendable antenna in which the above problems can be overcome and which can be operated, in its extended state, as the equivalent of a half-wave dipole antenna due to capacity capacitive coupling between the quarter-wave helical antenna element and the quarter-wave whip antenna element and compensate, in its retracted state, the deficient capacity component of the helical antenna element owing to capacity capacitive coupling between the metal sleeve and the helical antenna element and improve the efficiency of the whip antenna element as well as the efficiency of the helical antenna element by coupling the metal sleeve to a tube under the condition that the whip antenna element is fully inserted into the tube, and improve the mechanical reliability of the antenna.

In order to accomplish the above object, an capacitive coupling extendable antenna in accordance with an embodiment of the invention comprises: a helical antenna element having a metal sleeve of predetermined size; a whip antenna element coupled to the metal sleeve and to a stopper at opposed ends thereof respectively; feeding and supporting means for applying a radio frequency signal to the helical antenna element in the retracted state of the antenna and to the whip antenna element in the extended state of the antenna and for supporting the antenna elements to a telephone housing; first insulating means for electrically coupling the metal sleeve to a coiled radiation device of the helical antenna element through capacitive coupling; and second insulating means for electrically coupling the metal sleeve of the helical antenna element to the whip antenna element through capacitive coupling.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

With reference to FIGS. 1C, 1D and 2 to 6, there is shown an capacitive coupling extendable antenna in accordance with a preferred embodiment of the present invention.

Figure 1A:
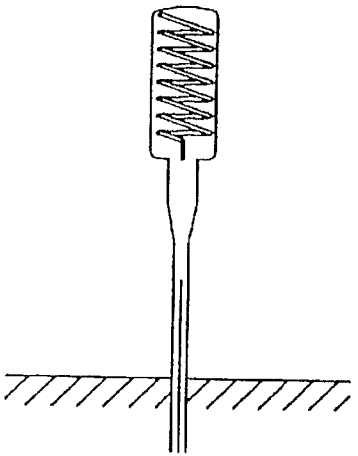
FIG. 1A (PRIOR ART)
FIGS. 1A and 1B are views showing a prior art extendable antenna in the extended state and in the retracted state respectively.
Figure 1B:
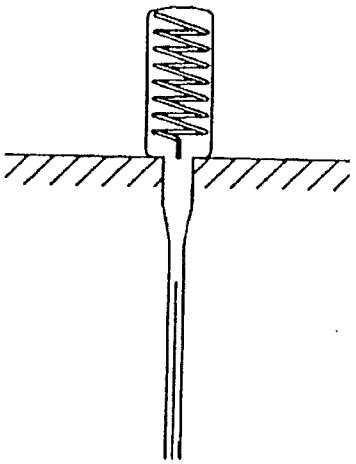
FIG. 1B (PRIOR ART)
Figure 1C:
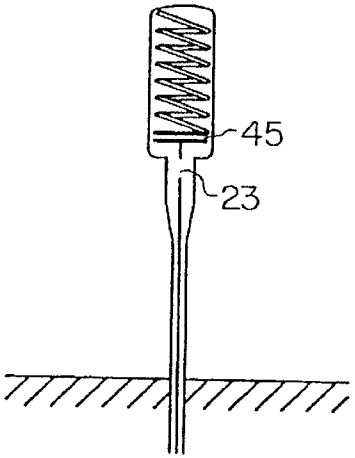
FIGS. 1C and 1D are views showing an capacitive coupling extendable antenna of the present invention in the extended state and in the retracted state respectively.
Figure 1D:
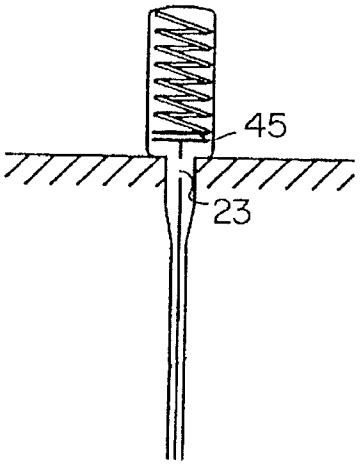
Figure 2:
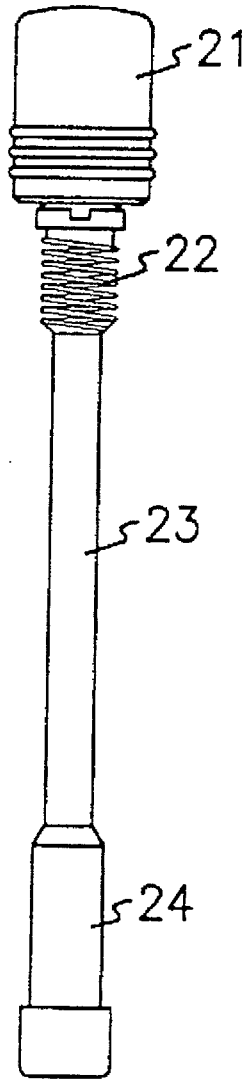
FIG. 2 is a view showing the appearance of the capacitive coupling extendable antenna of the invention.

As shown in FIG. 2, the capacitive coupled extendable antenna of the invention includes a helical antenna element 21, a fixing metal 22, a tube 23 and a stopper 24.

The fixing metal or feeding and supporting means 22 is a cylinder having a through hole of predetermined size. The outer surface of the metal 22 is threaded so that the antenna is stably mounted to a telephone housing by engaging the outer-threaded metal 22 to an inner-threaded antenna mount of the telephone housing.

Figure 4:
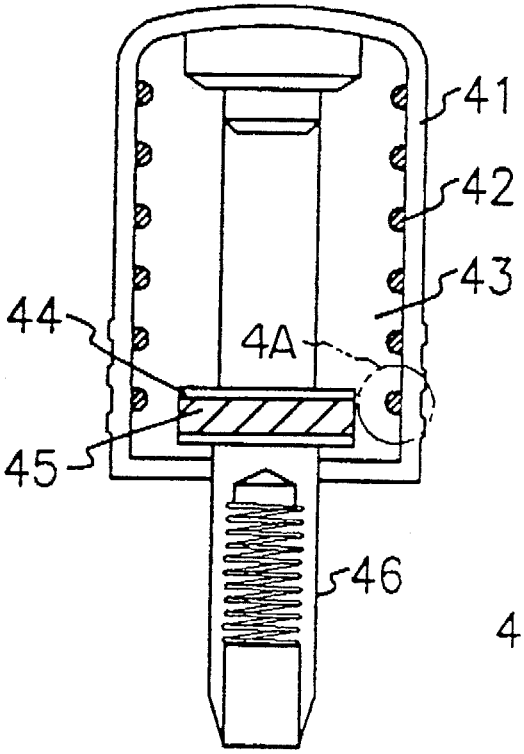
FIG. 4 is a detailed sectional view of a helical antenna element of the extendable antenna of FIG. 3.
Figure 4A:
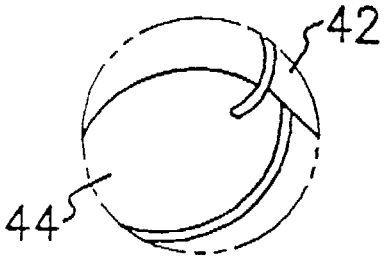
FIG. 4A is an enlarged view of a coiled radiation device and a copper plate.

The helical antenna element 21 has a cylindrical cover 41 as shown in FIG. 4. In the cover 41, a metal sleeve 46 having an enlarged diameter head is axially fitted into an end of the cover 41 such that the enlarged diameter head of the sleeve 46 is placed in the cover 41. The other end of the sleeve 46 is provided with an inner-threaded hole. A copper plate 44 is mounted on the enlarged diameter head of the sleeve 46 with interposition of a predetermined thickness of first insulator or first insulating means 45 such that the plate 44 is insulated from the sleeve 46 by means of the insulator 45. The copper plate 44, the insulator 45 and the metal sleeve 46 in the cover 41 are covered with another insulator or third insulating means 43. A coiled radiation device 42 connected to the copper plate 44 is wound about the insulator 43 at a predetermined coiling interval. FIG. 4A illustrates how the coiled radiation device 42 is connected to the copper plate 44 in an inlarged view.

Figure 3:
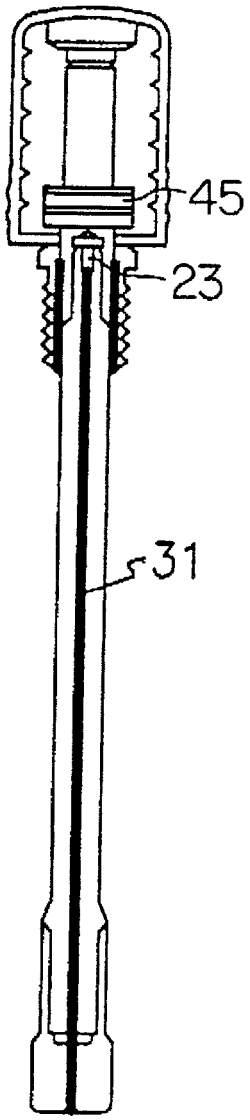
FIG. 3 is a longitudinal sectional view of the extendable antenna of FIG.2.

In order to couple the helical antenna element 21, the tube or second insulating means 23 and the stopper 24 to each other, outer-threaded opposed ends of the tube 23 are engaged with the inner-threaded hole of the sleeve 46 of the helical antenna element 21 and the stopper 24 respectively. When coupling the helical antenna element 21, the tube 23 and the stopper 24 to each other, the fixing metal 22 is fitted over the tube 23 prior to engaging the tube 23 with the sleeve 46 and the stopper 24. The stopper 24 is connected to a whip antenna element 31 as shown in FIG. 3, which element 31 is inserted into the hollow tube 23 when engaging the stopper 24 with the tube 23.

In the capacitive coupled extendable antenna of this invention, the nonmetal tube 23 is interposed between the whip antenna element 31 and the metal sleeve 46 of the helical antenna element 21. In the helical antenna element 21, the first insulator 45 is interposed between the copper plate 44 and the metal sleeve 46 in order for insulating the copper plate 44 from the sleeve 46. Therefore, the extendable antenna of this invention achieves the capacity capacitive coupling between the whip antenna element 31 and the metal sleeve 46 as well as the capacity capacitive coupling between the copper plate 44 and the metal sleeve 46 in the extended state of the antenna.

Figure 5:
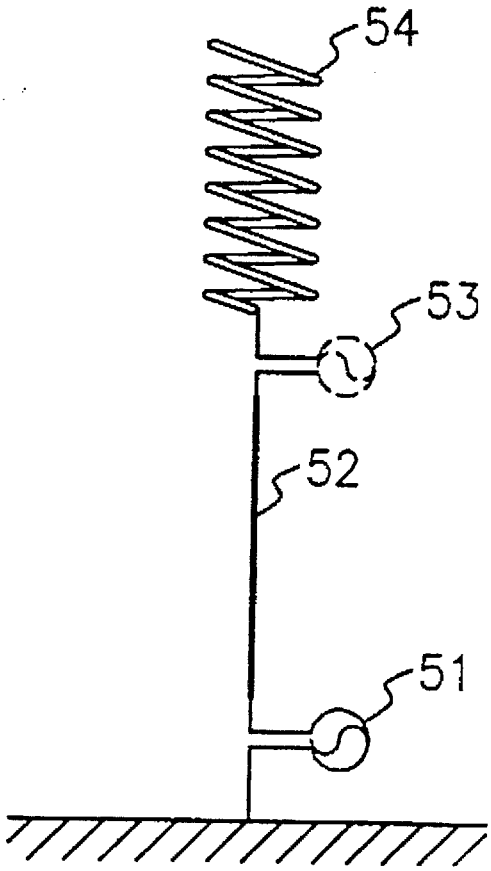
FIG. 5 is an equivalent circuit diagram of the extendable antenna of the invention in the extended state.

In the extended state of the antenna, the contact portion between the fixing metal 22 and the stopper 24 thus becomes a feed point 51 of the antenna as shown in FIG. 5. In addition, the quarter-wave helical antenna element 21 is connected to the top of the quarter-Wave whip antenna element 31 in the extended state of the antenna due to the capacity capacitive coupling between the whip antenna element 31 and the metal sleeve 46 and due to the capacity capacitive coupling between the copper plate 44 and the metal sleeve 46. This means that the quarter-wave helical antenna element 21 is coupled to the quarter-wave whip antenna element 31. Therefore, the effective length of the antenna is lengthened and this improves the radiation efficiency of the antenna.

FIG. 5 is an equivalent circuit diagram of the extendable antenna of the invention in the extended state.

As shown in FIG. 5, the feed point of the antenna in the extended state is the feed point 51. However, the antenna in this state is operated as the equivalent of a half-wave dipole antenna due to the capacity capacitive coupling between a quarter-wave whip antenna element 52 and a quarter-wave helical antenna element 54 so that the coupling portion between the two antenna elements 52 and 54 becomes an electric feed point 53 of the antenna.

Figure 6:
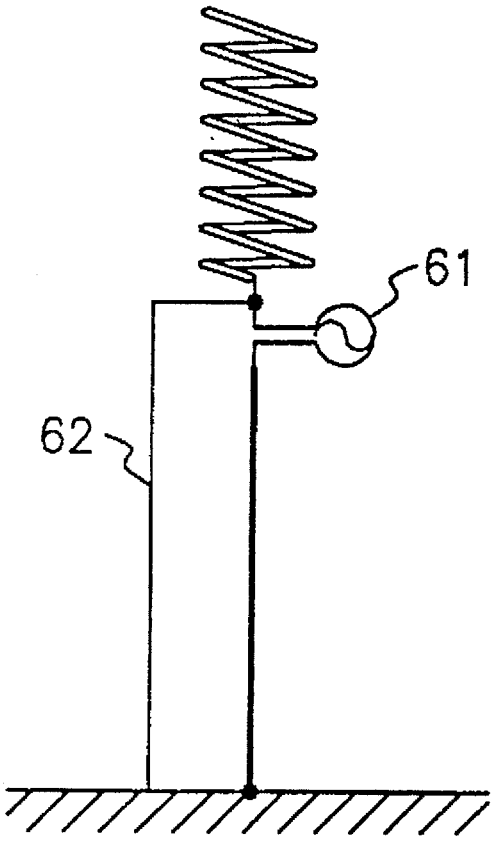
FIG. 6 is an equivalent circuit diagram of the extendable antenna of the invention in the retracted state.

In the capacitive coupling extendable antenna in the retracted state, the fixing metal 22 is electrically connected to the metal sleeve 46 of the helical antenna element 21 and becomes a feed point 61 of the antenna as shown in FIG. 6 which is an equivalent circuit diagram of the extendable antenna in the retracted state. In this case, the capacity capacitive coupling is achieved between the copper plate 44 and the metal sleeve 46 so that the helical antenna element 21 is operated.

At this time, the capacity capacitive coupling between the copper plate 44 and the metal sleeve 46 compensates for the deficient capacity component of the helical antenna element 21 so that the bandwidth of the helical antenna element of this antenna becomes wider than that of the prior art extendable antenna. As the whip antenna element 31 is short-circuited at the point of electrical phase of 90° when the antenna is retracted as shown in. FIG. 6, a$\lambda/4$ balun 62 is formed in the antenna so that the operating characteristics of the antenna are stabilized.

As the tube 23 is coupled to the metal sleeve 46 under the condition that the whip antenna element 31 is fully inserted into the tube 23, the mechanical strength of the coupling portion between the tube 23 and the sleeve 46 of this antenna is remarkably improved in comparison with the prior art antenna. In addition, as the whip antenna element 31 is made of a high elastic nickel-titanium alloy, the resilience of the antenna is prominently improved.

As described above, the present invention provides an capacitive coupling extendable antenna for cordless telephones and for portable cellular telephones. The antenna of this invention is operated, in its extended state, as the equivalent of a half-wave dipole antenna due to capacity capacitive coupling between the quarter-wave helical antenna element and the quarter-wave whip antenna element and compensates, in its retracted state, the deficient capacity component of the helical antenna element owing to capacity capacitive coupling between the metal sleeve and the helical antenna element. The antenna of this invention also improves the efficiency of the whip antenna element as well as the efficiency of the helical antenna element by coupling the metal sleeve to a tube under the condition that the whip antenna element is fully inserted into the tube. Another advantage of the antenna is resided in that the mechanical reliability of the antenna is improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An capacitive coupled extendable antenna comprising:

a quarter-wave helical antenna element having a metal sleeve of a predetermined size;

a quarter-wave whip antenna element coupled to said metal sleeve and to a stopper at opposed ends thereof respectively;

feeding and supporting means for applying a radio frequency signal to said helical antenna element in the retracted state of the antenna and to said whip antenna element in the extended state of the antenna and for supporting said antenna elements to a telephone housing;

first means for electrically coupling said metal sleeve to a coiled radiation device of the helical antenna element through capacitive coupling; and second means for electrically coupling said metal sleeve of the helical antenna element to said whip antenna element through capacitive coupling.

2. The capacitive coupled extendable antenna according to claim 1, wherein said helical antenna element comprises:

a metal plate provided on a side of said first means;

said metal sleeve provided on the other side of said first means such that the metal sleeve is opposed to said metal plate with interposition of the first means;

said coiled radiation device coupled to said metal plate; and third means for supporting and insulating said coiled radiation device while retaining a predetermined interval of coils of the coiled radiation device.

3. The capacitive coupled extendable antenna according to claim 1, wherein said whip antenna element is made of a high elastic nickel-titanium alloy and fully inserted into said second means, thus to be improved in its resilience and to improve the mechanical strength of a coupling portion between said metal sleeve and said second means.

4. The capacitive coupled extendable antenna according to claim 1, wherein said second means, said first means and said metal sleeve are assembled into the antenna such that said quarter-wave whip antenna element and said quarter-wave helical antenna element are coupled to each other through double capacitive coupling and the antenna is operated as the equivalent of a half-wave dipole antenna.

5. The capacitive coupled extendable antenna according to claim 1, wherein said first means achieves capacity capacitive coupling between the metal sleeve and the coiled radiation device of the helical antenna element in the retracted state of the antenna, thus to make the antenna in the retracted state be operated as if a capacitor is connected to a lower portion of said helical antenna element.

6. The capacitive coupled extendable antenna according to claim 1, wherein said whip antenna element is short-circuited at a point of electric phase of 90° in the retracted state of the antenna, thus to form a$\lambda/4$ balun and stabilize the operating characteristics of the antenna.

* * * * *